US005758533A

United States Patent [19]

Quehen et al.

[11] Patent Number: 5,758,533

[45] Date of Patent: Jun. 2, 1998

[54] IMBRICATED ROLL PLANISHER AND PROCESS FOR ITS USE

[75] Inventors: Andre Quehen, Pontoise; Bernard Rossigneux, Montbrison; Michel Chevet, Saint-Etienne, all of France

[73] Assignee: CLECIM, Cergy-Pontoise, France

[21] Appl. No.: 632,170

[22] Filed: Apr. 15, 1996

Related U.S. Application Data

[63] Continuation-in-part of Ser. No. 423,511, Apr. 17, 1995, Pat. No. 5,680,785.

[30] Foreign Application Priority Data

Apr. 15, 1994 [FR] France ..... 94 04551
Apr. 14, 1995 [FR] France ..... 95 04557

[51] Int. Cl.[6] ..... B21D 1/02

[52] U.S. Cl. ..... 72/163; 72/164

[58] Field of Search ..... 72/164, 163, 165, 72/161, 160

[56] References Cited

U.S. PATENT DOCUMENTS 2,852,065 9/1958 Peterson ..... 72/164
4,313,322 2/1982 Malinowski ..... 72/164
4,454,738 6/1984 Buta ..... 72/164
4,698,990 10/1987 Petri ..... 72/165

FOREIGN PATENT DOCUMENTS 2123896 4/1972 Germany ..... 72/164
1378978 3/1988 U.S.S.R. ..... 72/165

*Primary Examiner*—Daniel C. Crane
*Attorney, Agent, or Firm*—Pollock, Vande Sande & Priddy

[57] ABSTRACT

An imbricated roll planisher comprising, inside a fixed stand, two planishing systems each including a plurality of live planishing rolls with parallel axes, rotatably mounted in a supporting chassis and each associated with at least one row of support rollers, the assembly being pressed, on the side remote from the strip to be planished, against a resistant bearing beam. At least one of the planishing systems bears against the corresponding bearing beam via a set of hydraulic jacks distributed across the entire surface covered by the system, in parallel rows of at least two jacks, each row corresponding to one of the live planishing rolls. By individually adjusting the position and the pressure of the jacks of each of the rows, it becomes possible to determine the degree of imbrication and the distribution of the force applied on each of the live rolls, it being possible to make this adjustment even while the strip is feeding through.

15 Claims, 4 Drawing Sheets

IMBRICATED ROLL PLANISHER AND PROCESS FOR ITS USE

This application is a Continuation-In-Part of U.S. patent application Ser. No. 08/423,511, filed Apr. 17, 1995, now U.S. Pat. No. 5,680,785 issued Oct. 28, 1997.

FIELD OF THE INVENTION

The invention relates to a machine for planishing continuous strip flat products, especially metal strips, and a process for using such a machine.

BACKGROUND OF THE INVENTION

For the planishing of flat products, particularly metal strips such as laminated sheets, use is often made of a multiroll planisher comprising two sets of rolls with parallel axes, forming respectively two planishing systems between which the strip to be planished is made to pass in a longitudinal direction perpendicular to the rolls. The rolls are offset longitudinally and vertically so as to imbricate and set up an undulating path for the strip which is thus subjected to the effects of stretching-rolling in alternate directions on either side of a substantially horizontal mean feed plane.

The assembly is located in a fixed supporting stand comprising two spaced vertical members and is associated with means for adjusting the imbrication of the rollers in order to adjust the planishing efficiency according to needs and the characteristics of the strip, particularly its dimensions and the nature of the metal.

The passage of the strip between the rolls following an undulating path tends to force the two systems apart, and so their imbrication must be permanently maintained by bearing upon the fixed stand.

This is why each planishing system located, respectively, on either side of the strip feed plane, bears, generally, on a strong cross member forming a bearing beam and extending across the whole gap of the planishing system.

Such arrangements are described, for example, in document DE-A-1.552.086.

In most cases, the lower planishing system is fixed in position, as is the corresponding bearing beam. In contrast, the upper system has to be able to move vertically in order to adjust the gap between the two systems. To achieve this, the cross member forming the upper bearing beam is mounted so as to slide vertically between the vertical members of the bearing stand, its position being adjustable by mechanical or hydraulic actuators mounted in the corners of the stand and allowing the level of the upper bearing beam and the adjustable system to be adjusted in relation to the fixed lower system. If the need arises, the actuators can be set differently, so as to create a forward/backward or sideways inclination of one system in relation to the other, in order to reduce the imbrication of the rollers in the strip feed direction, for example.

Because the forces produced for planishing are very high, particularly when this operation is performed cold, endeavors are made to provide planishers with a structure that is as rigid as possible so as to be able to control the effects of planishing. To date, such planishers have therefore been very heavy machines, basic in design and offering only limited adjustment accuracy.

Yet, some yielding of various bearing parts under the effect of the forces applied is unavoidable, and may cause live rolls to deflect slightly and result in stresses being irregularly distributed across the width of the strip.

In a particular arrangement described in DE-A-2.747.331, each live roll is pressed by its supporting rolls against an individual cross member which bears directly on the uprights of the stand. In this case, the deflection of each cross member can be compensated for by means of an adjustable thickness spacer, inserted between each cross member and the supporting rolls, and made up of two flats with inclined faces forming a wedge, it being possible to increase the thickness of said spacer, in the central part, by means of an eccentric, so as to maintain the straightness of the corresponding live roll.

Such a machine is not, however, compatible with the increasingly greater planishing forces now being called for to cater for the evolution of products and the needs of the clientele. Furthermore, the adjustments must be made in advance and, as a result, off load, with the relative positions of the wedges being difficult to correct during planishing.

In a more perfected arrangement described in EP-A-0.577.170, each planishing roller bears, via a system of adjustable-thickness wedges, against a supporting chassis which itself bears against the corners of the bearing beam via fixed spacers located along the axis of the four jacks that adjust the height of the supporting beam.

Two rows of flat jacks distributed between said fixed spacers, are interposed between the supporting beam and the chassis of each planishing system, respectively on its input and output side, the distribution of pressures between said flat jacks being adjusted so as to compensate for the deflection of the supporting beam under the effect of the forces applied to maintain the straightness of the supporting chassis, and as a result, that of the planishing rolls which bear upon said supporting chassis.

This adjustment can be made under load and it is therefore possible to maintain the flatness of the chassis and, as a result, the degree of imbrication of the rolls, by adapting to variations in forces applied during operation.

Nevertheless, other parameters must be taken into account if more accurate control of the effects of stretching-rolling applied to the strip is required In particular, the inventor thought it would be desirable to have the possibility of not only taking into account foreseeable deformations of the machine, but also of distributing the planishing effect when under load to correct for flatness faults detected on the strip. In machines used until now, yield compensation is only provided to maintain the parallelism of the rolls and the degree of imbrication which is adjusted in advance.

SUMMARY OF THE INVENTION

To meet increasingly stringent quality requirements, the object of the invention is therefore to overcome all the above mentioned drawbacks by means of simple robust devices capable of resisting very large planishing forces, for example for metal sheet cold rolling, and which not only make it possible to compensate for all yielding, but also to act very precisely on the distribution of planishing stresses applied to the strip at the level of each live roll, it being possible to modify this distribution even while the strip is feeding through.

According to the invention, the planisher comprises:

a fixed supporting stand, having two vertical members spaced apart on either side of a longitudinal median plane, two resistant bearing beams spaced apart from each other, respectively, a lower bearing beam and an upper bearing beam, two parallel roll planishing systems, located respectively above and below the strip, and whose rolls are imbricated in a manner so as to set up an undulated path for the strip, respectively, a lower planishing system bearing upon the lower bearing beam and an upper planishing system bearing upon the upper bearing beam;

each planishing system comprising a row of parallel live rolls each associated with at least one row of pressure rolls, the assembly being mounted in a supporting chassis, each live roll being mounted in a rotary way, at its ends, on two bearings defining an axis of rotation of the roll perpendicular to the feed direction of the strip, at least one of said planishing systems bearing upon the corresponding bearing beam via a set of individually adjustable actuators distributed across the whole surface covered by said system, said adjustable actuators being arranged in rows, parallel to the axes of the live rolls, each comprising at least two actuators spaced apart from each other symmetrically on either side of the longitudinal median plane of the stand, each actuator has an adjustable length, comprising on one side an element which bears against the bearing beam, and on the other side an element with a bearing end which bears on said planishing system, said system being associated with means for individually adjusting the position of the bearing end of each actuator in relation to the bearing beam.

In a particularly advantageous way, each live roll is associated with a row of actuators distributed across the whole length of the roll and centered in a plane perpendicular to the feed direction and passing substantially through the axis of the corresponding live roll.

Copending application Ser. No. 08/423,511, filed Apr. 17 1995, covers a planisher in which the chassis of each system includes two side pieces designed to support the bearings of the live rolls, and between which a deformable plate extends which bears against the ends of the actuators, thus reproducing a profile defined by said actuators which are individually adjustable, and determining a corresponding profile of the live generating lines of the planishing rolls.

This application covers an even more perfected planisher in which the supporting chassis of at least one of the planishing systems comprises a piece in the form of a frame inside which a plurality of cross girders are arranged one next to another, equal in number to the planishing rolls, mounted so as to slide in said frame, independently of each other, each in a clamping plane passing through the axis of the corresponding planishing roll, each live planishing roll bearing, over all its length, on said girder, via its supporting rolls and each girder bearing individually on the bearing beam via at least two hydraulic jacks interposed between the bearing beam and the girder and distributed across the length of said girder Preferably, each planishing roll is mounted in a rotary way, at its ends, on two centering bearings linked respectively to the corresponding ends of the associated girder, in such a way as to allow a relative limited displacement of said bearings of the roll in relation to the girder when acted on by said hydraulic jacks.

In a particularly advantageous way, the planisher comprises means for adjusting the position of each of the jacks interposed between the supporting beam and each cross girder for allow individual adjustment of the profile and of the level of at least some of the live planishing rolls in relation to the mean feed plane of the strip. The jacks may also be simultaneously adjusted, either to individually set the level of each of the live rolls or to act globally on the imbrication of the rolls.

According to another essential characteristic, the machine comprises means for adjusting the pressure of each of the jacks interposed between the bearing beam and each cross girder for individual adjustment of the clamping force supported by at least some of the planishing rolls.

In an advantageous way, the width of each cross girder is at the most equal to the distance between the axes of the planishing rolls, and the jacks which press each girder against the bearing beam each have an elongated section, each jack having a piston whose width in the direction transverse to the girder does not substantially exceed the width of said girder and whose length is chosen so as to define a useful section of the chamber of the jack compatible with the bearing force to be exerted taking into account the number of jacks acting on each girder.

Preferably, each cross girder bears upon the bearing beam via three jacks, respectively a central jack and two side jacks, said jacks being associated with means for adjusting the position of the central jack for adjustment of the imbrication of the corresponding roll and means for correcting the relative positions of the two other jacks to control the profile of the roll and its variation under the effect of the forces applied.

According to another advantageous arrangement, the pressure jacks are provided in at least one intermediate supporting piece interposed between the bearing beam and the set of cross girders, and in which the bodies of the jacks are housed, said jacks being arranged in several rows parallel to the cross girders.

According to one particular embodiment, the bodies of the jacks located at the same level on the different cross girders are brought together in a single piece extending over all the girders and in which cavities are provided forming the chambers of the jacks and in which pistons are mounted in a sliding way which bear upon the corresponding girder.

According to another preferred embodiment, the supporting chassis comprises a rectangular frame surrounding all the rolls and associated with a plurality of guide bulkheads spaced apart from each other so as to define flat cavities in which the cross girders are housed, the two ends of each cross girder being provided with means for bearing against the frame with the possibility of sliding. Furthermore, the entire supporting chassis on the side furthest from the roll is closed by a plate covering all the cross girders so as to form a box, said plate being provided with, at right angles to each girder, a plurality of passage holes for the pistons of the jacks interposed between each girder and the bearing beam. The assembly thus forms a cartridge which can be withdrawn from the planisher by a sideways movement in a direction parallel to the axes of the rolls.

Moreover, the invention also covers a process for adjusting the effect of planishing performed on a strip defined in an imbricated roll planisher of the type claimed.

According to the invention, the position of one of the bearing beams is adjusted in relation to the other to determine a reference level of the whole planishing system in relation to the other and, each planishing roll being mounted, with its pressure rolls, on a cross girder mounted so as to slide perpendicularly to the passage plane of the strip and bearing on the corresponding bearing beam via at least two hydraulic jacks, the relative levels of at least one group of planishing rolls are precisely determined in relation to a reference level by individual adjustment of the positions of the pressure jacks corresponding to each of the rolls, so as to define a given degree of imbrication of each of the rolls of said group, the pressures applied on each of said jacks being limited to a safety value corresponding to a maximum planishing force taken by each planishing roll.

In addition, it was seen that according to one preferred embodiment, each planishing roll supporting beam is associated with at least three pressure jacks, respectively a central jack and two side jacks.

In this case, according to a particularly advantageous process, the level of each planishing roll corresponding to a given degree of imbrication is controlled by adjusting the position of the central jack of the corresponding beam, according to the foreseeable yielding of the different parts of the stand, taking into account the forces applied, the difference between the measured positions of the two side pressure jacks of said girder then being determined, and the said positions being corrected to bring the measured difference back to a reference difference corresponding to the parallelism of the roll with the reference level.

Furthermore, according to the planishing force corresponding to the sum of the pressures measured respectively on the three jacks, the pressures are distributed between the latter taking into account the relative positions of said jacks, so that the live generating line of the considered planishing roll, in contact with the product, is maintained in a straight line.

According to another particularly advantageous characteristic of the process, in the case where the planishing machine comprises an odd number n of imbricated rolls, respectively (1, 3, 5. . . . n) on one of the systems and (2, 4, 6 . . . n−1) on the other system, the position of the jacks corresponding to at least two rolls, respectively (p) and (q) of each of the two systems, located respectively above and below the strip, is adjusted, and the pressure of the two jacks corresponding to the two pairs of rolls, respectively (p−1, p+1) and (q−1, q+1) surrounding each of said rollers (p, q) adjusted in position is adjusted so as to determine at least two bends in opposite directions on said rollers (p, q), the positions of the latter in each of the two systems and their relative levels in relation to the reference level, in addition to the pressures applied on the rolls surrounding them, being determined according to the characteristics of the strip to be planished so as to obtain the desired planishing effect required.

BRIEF DESCRIPTION OF THE DRAWINGS

Other advantageous characteristics will become apparent from the following description of a particular embodiment of the invention, provided by way of example and shown in the accompanying drawings.

DESCRIPTION OF PREFERRED EMBODIMENT

Figure 1:
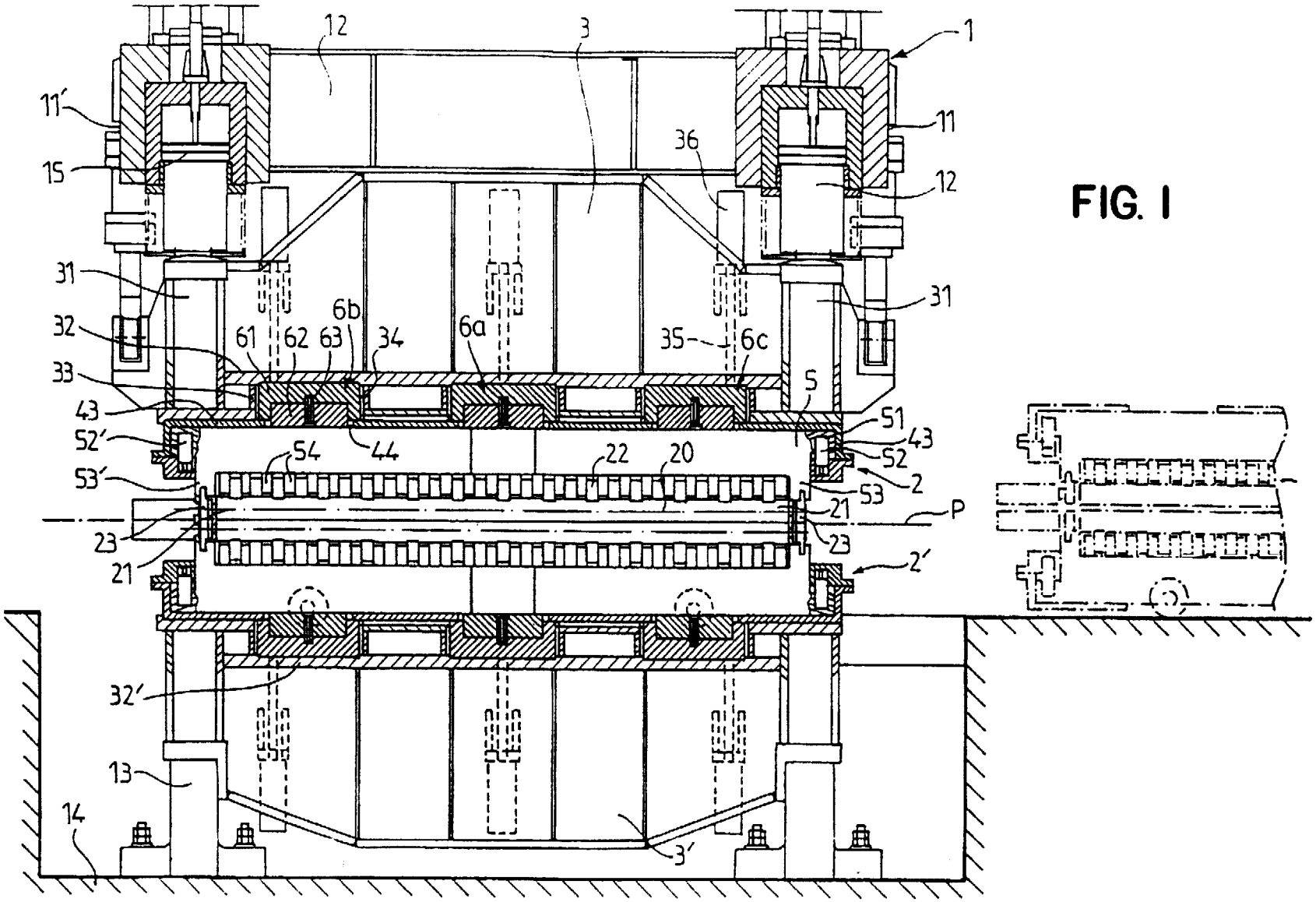
FIG. 1 is a general view of a planishing machine according to the invention, shown as a partial cross-sectional view in a plane transverse to the feed direction.
Figure 2:
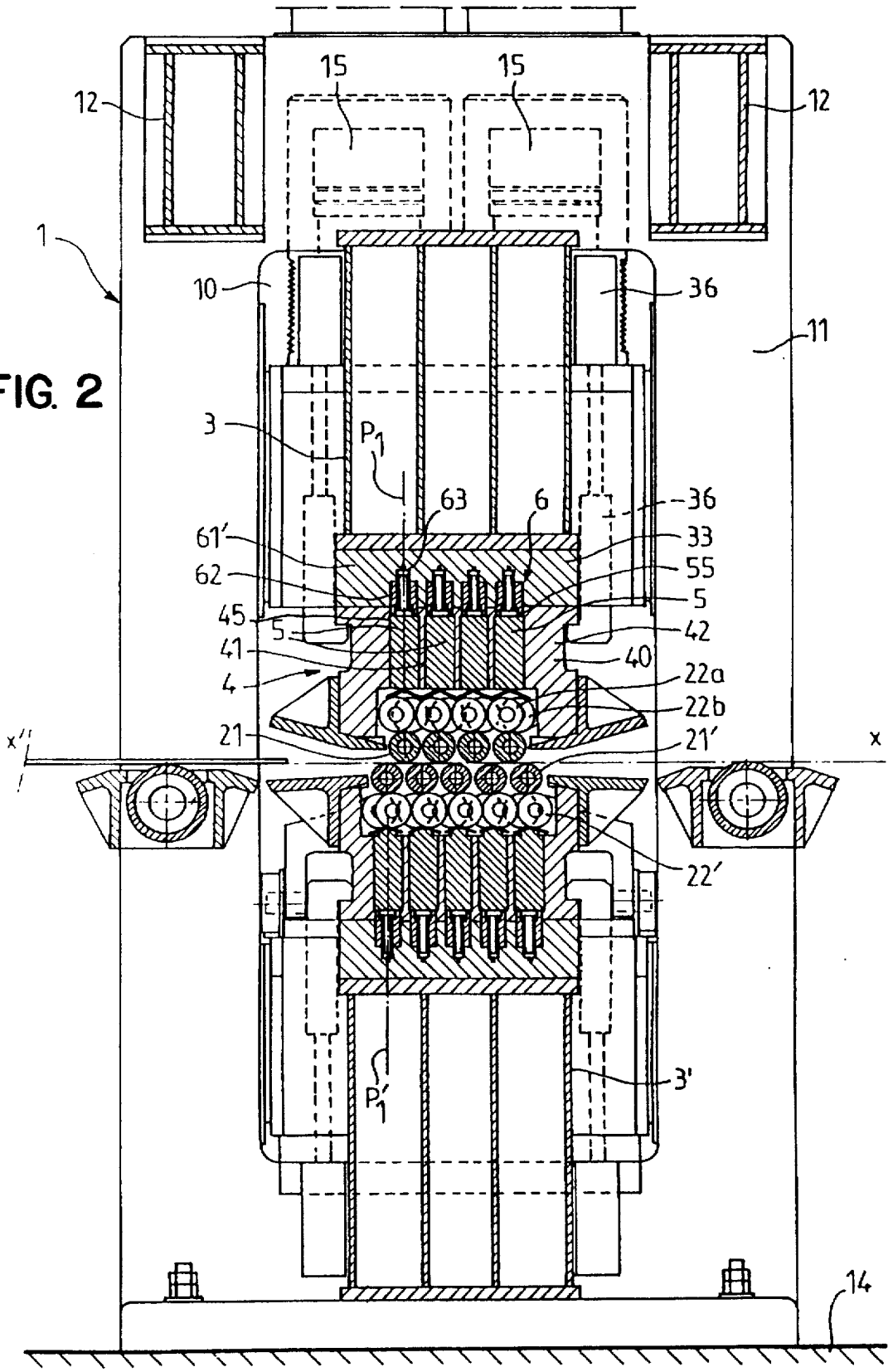
FIG. 2 is an enlarged-scale view of the planishing machine, as a longitudinal cross-section, in a median plane parallel to the feed direction.

FIGS. 1 and 2 show an entire planisher comprising a fixed stand 1 made up of two spaced vertical members 11, 11' linked by cross girders 12 and fixed at their base 13 to a seating block 14.

Two crosspieces, respectively upper 3 and lower 3' extend between the two vertical members 11, 11', the ends of which pass into windows 10 provided respectively in vertical members 11, 11'.

The lower crosspiece 3' is fixed and bears directly upon base 13 of stand 1.

Conversely, upper crosspiece 3 is adjustable in height and can slide vertically when acted upon by four hydraulic or mechanical jacks 15 provided in the upper portion of vertical members 11, 11'.

Each crosspiece 3, 3' is made in a particularly rigid way and forms a resistant bearing beam defining a substantially flat bearing face 32, 32'.

Two planishing systems, respectively upper 2 and lower 2', are arranged between the two bearing beams 3, 3' located on either side of a passage plane P of the strip A to be planished, the side furthest from the strip bearing against bearing faces 32, 32' respectively on upper bearing beam 3 and lower bearing beam 3'.

All these arrangements are known and do not call for a detailed description.

Each planishing system 2, 2' comprises a plurality of live rolls 21 spaced apart from each other, their axes being perpendicular to the feed direction x'-x of the product to be planished. Each live roll 21 is mounted in a rotary way, at its two ends, on two bearings 23 defining an axis of rotation 20 of the roll and bears upon rolls or supporting rollers 22, the assembly being mounted in a supporting chassis which is pressed against bearing beam 3.

In the embodiment shown in the figures, the upper system 2 comprises four live rolls 21 each associated with two rows of supporting rollers 22 centered respectively on two axes symmetrically spaced either side of a vertical plane of symmetry P1 passing through the axis of the corresponding live roll 21.

The lower system 2' comprises five live rolls 21' each associated with two rows of supporting rollers 22' and whose axes are located in vertical planes of symmetry P'1 which are off-set by a half-step in relation to the planes of symmetry P1 of upper rollers 21, in such a way that, in a known way, a metal strip passing in a longitudinal direction x'-x follows an undulated path, on either side of a mean feed path P between the two rows of rolls 21, 21', the amplitude of the undulations depending on the degree of imbrication of rollers 21, 21'.

Figure 3:
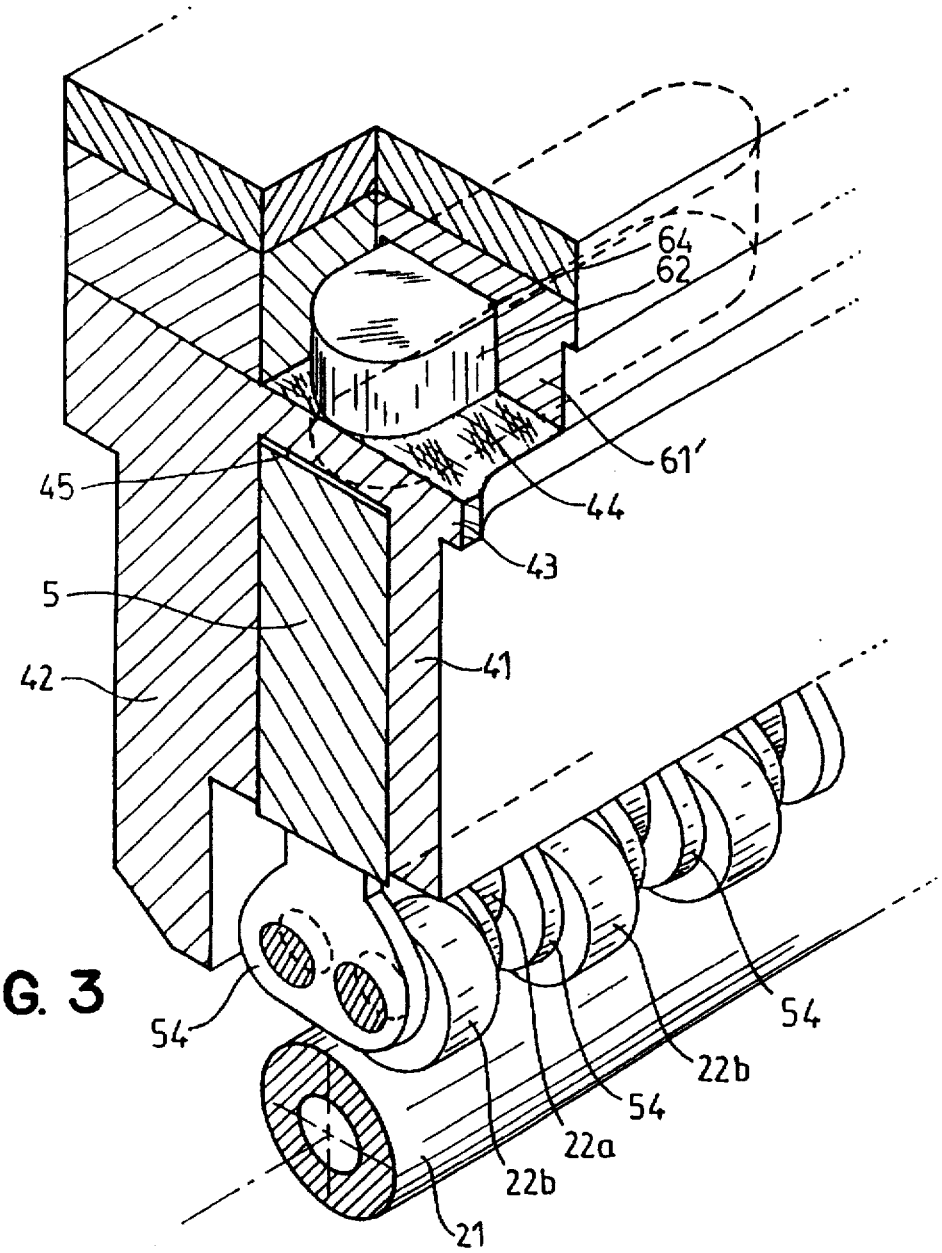
FIG. 3 is a detailed perspective diagram with a partial cut-away.

According to the invention, as shown in FIGS. 1 to 3, the supporting chassis 4 of each planishing system consists of a hollow piece 40 in the form of a frame in which several cross girders 5 are housed arranged one next to the other inside frame 40 and each supporting one of the live rolls 21 and its supporting rollers 22. The hollow piece 40 therefore forms a frame of rectangular section surrounding all the cross girders 5 which are able to slide individually inside frame 40 with the rolls and rollers.

Chassis 4 forms a rectangular case defined by two large sides 42 parallel to planes of symmetry P1 and two small sides 43 perpendicular to said planes, and between which two intermediate bulkheads 41 extend which define several elongated housings 45 inside frame 40 in which are slipped, respectively, cross girders 5. Each girder 5 is centered on a vertical plane of symmetry P1 passing through the axis of the corresponding live roll 21, its two ends being provided with protruding parts 53, 53' in which the two bearings 23, 23' of live roll 21 are housed respectively.

Moreover, each girder 5 is supported, at each of its two ends, by jacks 52, which bear upon the two corresponding bearing parts of each side piece 43 of frame 4.

As shown schematically in FIG. 3, each live roll 21 bears on two rows of supporting rollers 22*a*, 22*b* which are mounted in a rotary way on intermediate supports 54 fixed onto the lower part of girder 5, about axes alternately spaced either side of the vertical plane of symmetry P1 of the girder.

It should be noted that the mounting of bearings 23 of live rolls 21 at the two ends of the corresponding girder 5 is designed simply to support roll 21 but with the possibility of a slight displacement in relation to the girder, roll 21 bearing on the latter only via its supporting rollers 22.

In a general way, each girder 5 has a rectangular cross section whose width is of the same order as the diameter of corresponding roll 21 and at the most equal to the axis-to-axis spacing of the rolls and whose height is at least equal to the width and, preferably, distinctly greater than said width.

As a result, each girder 5 forms, with the corresponding live roll 21 and its supporting rollers 22*a*, 22*b*, a relatively rigid assembly, suspended in frame 4 by jacks 52, 52' and which can slide vertically inside its housing 45, along plane of symmetry P1 which therefore constitutes a clamping plane of live roll 21.

In addition, supporting rollers 22*a*, 22*b* of each roller 21 are alternately offset on either side of plane of symmetry P1 so as to be able to insert themselves between the rollers of adjacent rolls. Thus, each girder 5 with its live roll and supporting rollers can slide individually in its housing without interfering with the sliding movement of adjacent girders.

For this purpose, each support girder 5 bears on bearing beam 3 independently of adjacent girders via a row of several jacks 6 interposed between each girder 5 and bearing face 32 of bearing beam 3 and distributed over the whole length of girder 5.

Jacks 6 are housed in a piece 33 which is a welded metal construction covering all the bearing face 32 of bearing beam 3 and in which jacks 6 are arranged in several rows corresponding respectively to each cross girder 5, each jack 6 comprising a piston 62 and a body 61 housed in intermediate piece 33.

It should be noted that to individually act on each girder 5, the width of the pistons of the corresponding jacks must not exceed that of the girder. Circular section jacks could only therefore develop fairly reduced forces and would necessitate use of a large number of jacks distributed across the whole length of the girder in order to exert sufficient pressing force on the corresponding live roll.

Such an arrangement would complicate the hydraulic circuits and regulation of the overall machine.

This is why, according to another particularly advantageous embodiment of the invention, use is preferably made of jacks having an elongated section, the width of piston 62 of each jack 6 being slightly less than that of girder 5, but covering a much greater length in the longitudinal direction of girder 5.

To ensure correct sealing of each jack, the piston and corresponding chamber 64 have an elongated section with, preferably, circular rounded ends so as to provide an oblong form, as shown schematically in FIG. 3.

It is thus possible to considerably increase the useful cross-section of each jack and obtain sufficient force by using only a small number of jacks per girder, the length of each girder being chosen to define a useful cross-section of the chamber of the jack compatible with the bearing force to be exerted taking into account the number of jacks acting on each girder.

In a preferred way, for example, each girder 5 can be associated with only three jacks, respectively a central jack 6*a* centered in the median plane of the planisher and two side jacks 6*b* and 6*c*.

Moreover, reducing the number of jacks in this way makes it possible to simplify production of intermediate piece 33.

Indeed, as shown in the figures, the bodies 61 of all the jacks located respectively at the same level on each of the parallel girders 5 can be brought together into a single piece 61', which extends over the entire width of beam 3 in a single cavity in the form of a slot 34. In this piece 61', several bores are made centered respectively in the median planes P1 of the different girders 5, each forming a chamber 64 of a jack whose piston 62 bears against the upper face 55 of the corresponding girder 5. Of course, oil feed and return circuits, not shown on the diagram, are provided in piece 61'.

Furthermore, each jack 6 is associated with a position sensor 63 housed in piece 61'.

Such arrangements therefore allow not only the position of each jack but also the pressure supported or applied to the girder to be very accurately set to the corresponding level.

As will be seen in greater detail further on, by this individual pressing of each planishing roll against the bearing beam by means of a girder and a series of hydraulic jacks, it becomes possible to control, on the one hand, the degree of imbrication and the distribution of stretching-rolling forces applied by each of the live rolls, and on the other hand, the distribution of planishing stresses over the length of each roll.

It should be noted that the height of the supporting girders 5 of the live rolls 21 can be distinctly greater than their width, which gives them a relatively high degree of rigidity and makes it possible to distribute the effects of the adjustment jacks across the whole length of the live roll without interfering with the sliding of the assembly. Indeed, each girder 5 is perfectly maintained laterally in the corresponding housing 45 of frame 4 and elastically resists, without risk of buckling, the actions exerted by jacks 6, whose effects on live rolls 21 can therefore be extremely precise.

Lower planishing system 2' which bears on lower bearing beam 3' is produced in quite the same way, but is normally fixed in height whereas the general level of upper bearing beam 3 with planishing system 2 can be adjusted in height by means of jacks 15.

Preferably, the upper part of frame 4 is closed by a plate 43 which covers all the girders 5 and in which rows of holes 44 are made at right angles to each girder for the passage of pistons 62.

As a result, frame 4 forms a box containing all girders 5 with rolls 21 and their supporting rollers 22 and can advantageously constitute a detachable cartridge. This is pressed and fixed in a removable way against bearing beam 3 by clamping claws 35 actuated by jacks 36 which bear against supporting beam 3, the upper plate 43 bearing on bearing face 32 of bearing beam 3 via pieces 61' forming the bodies of jacks 6.

As mentioned above, each girder 5 bears, at its two ends, on sides 43 of frame 4 by means of jacks 52, 52'. Said jacks are adjusted so as to support the weight of girder 5 with supporting rollers 22 and corresponding live roll 21 and keep girder 5 pressed against corresponding jacks 6 without opposing the sliding of the beam under the effect of said jacks.

Each cartridge formed by frame 4, and the assembly of girders 5, rolls 21 and associated rollers 22, can be withdrawn from the machine by displacement parallel to the axes of the rolls and girders.

For this purpose, lower cartridge 4' is provided with rollers 45 which can roll on rails 16 of adjustable height (FIG. 2). Furthermore, the two planishing systems can be withdrawn at the same time, the upper system 2 resting on the lower system 2' via stops which are not shown.

For this, upper cartridge 4 is first of all lowered by jacks 36 until it comes to rest on lower cartridge 4'. Claws 35 are then retracted and bearing beam 3 raised by jacks 15 to an upper position represented by the dotted lines in FIG. 1 thus freeing cartridge 2.

Rails 16 are then raised by means not shown carrying the two superposed cartridges 2, 2' up to the level of the fixed rails 17 provided on a floor next to the machine in the extension of rails 16.

The assembly of the two systems 2, 2' resting one on top of the other can now be rolled into the position A represented on the right of FIG. 1.

After verification and maintenance of the different organs and their possible replacement, the two systems 2, 2' are moved back into the machine by conducting the same operations in the reverse order.

Thanks to the arrangements described above, the invention provides two means for adjusting the spacing of the planishing systems and the imbrication of the rolls.

On the one hand, the four jacks 15 are used to define a reference level of upper bearing beam 3 and of the upper planishing system in relation to a base level of lower planishing system 2' defined by lower bearing beam 3'.

On the other hand, according to an essential embodiment of the invention, a means is also provided to individually adjust the level of each planishing live roll 21, 21' of the two systems 2, 2', by means of corresponding jacks 6 which can be adjusted in position simultaneously or individually so as to adjust the relative positions, on the one hand of upper rollers 21 in relation to the reference level determined by jacks 15 and on the other hand of lower rollers 2' in relation to the base level determined by lower bearing beam 3'.

It is thus possible to adjust, individually, the degree of imbrication of each live roll and to modify it, possibly under load, in order to adjust the distribution of planishing forces between the rolls, even while the strip is feeding through.

For example, it is possible, as is usual, to progressively reduce the imbrication of the rolls in the feed direction or, according to needs, slightly tip one system in relation to the other, while retaining a fixed bearing force for each system.

But thanks to the multiple adjustment possibilities offered by the invention, it is possible to determine, individually, not only the position but also the profile of each roll, and, as a result, control the effects of planishing in a much more flexible and precise way compared to previous arrangements.

Indeed, as has been shown, each jack 6 is associated with a position sensor 63 and it is possible, first, to adjust in the same way and simultaneously all the jacks corresponding to a support girder 5 to control the level of the corresponding live roll 21 in order, for example, to vary the imbrication rate and the amplitude of undulations, from the input to the output of the planishing machine.

Moreover, starting from the imbrication level thus determined of each live roll 21, it is also possible to act individually on the corresponding jacks 6, on the one hand to correct the deflection of the rolls resulting from the differential yielding of the different parts of the stand, and on the other hand to modify, if necessary, the distribution of stresses in the transverse direction of the strip, particularly to differentiate planishing rates between the center and edges of the sheet.

Indeed, even if extremely rigid pieces are used, it is impossible to completely avoid deformations of the different parts of the stand under the effect of the extremely large forces which they must withstand, and bearing face 32 of bearing beam 3 which serves as a reference for the positioning of jacks 6 may not therefore remain perfectly flat.

However, it is possible to determine by calculation foreseeable deformations of all the elements according to the forces applied and establish a mathematical model making it possible to calculate not only the overall deflection of the bearing beam, but also the corresponding yielding that occurs at the level of each live planishing roll to the force applied by the considered roll.

Each jack 6 being associated with a position sensor 63, it is possible, using information from the mathematical model, to adjust the respective positions of the jacks and correct the deflection of corresponding roll 21.

In particular, in the embodiment shown in the figures comprising three jacks 6 for each girder 5, the position adjustment of side jacks **6*b*, 6*c* is used to set the mean level of corresponding live roll 21, and the mathematical model to determine the foreseeable yielding of the corresponding part of bearing beam 3 according to the forces applied and all the parameters of the installation, thus allowing the position of the central jack 6*a* to be determined that will ensure the straightness of corresponding roll 21**.

It is even possible, starting from this level, to slightly vary the relative positions of the pistons to give the roll a given profile and, for example, to apply a positive or negative cambering effect to it in order correct certain flatness faults.

Figure 4:
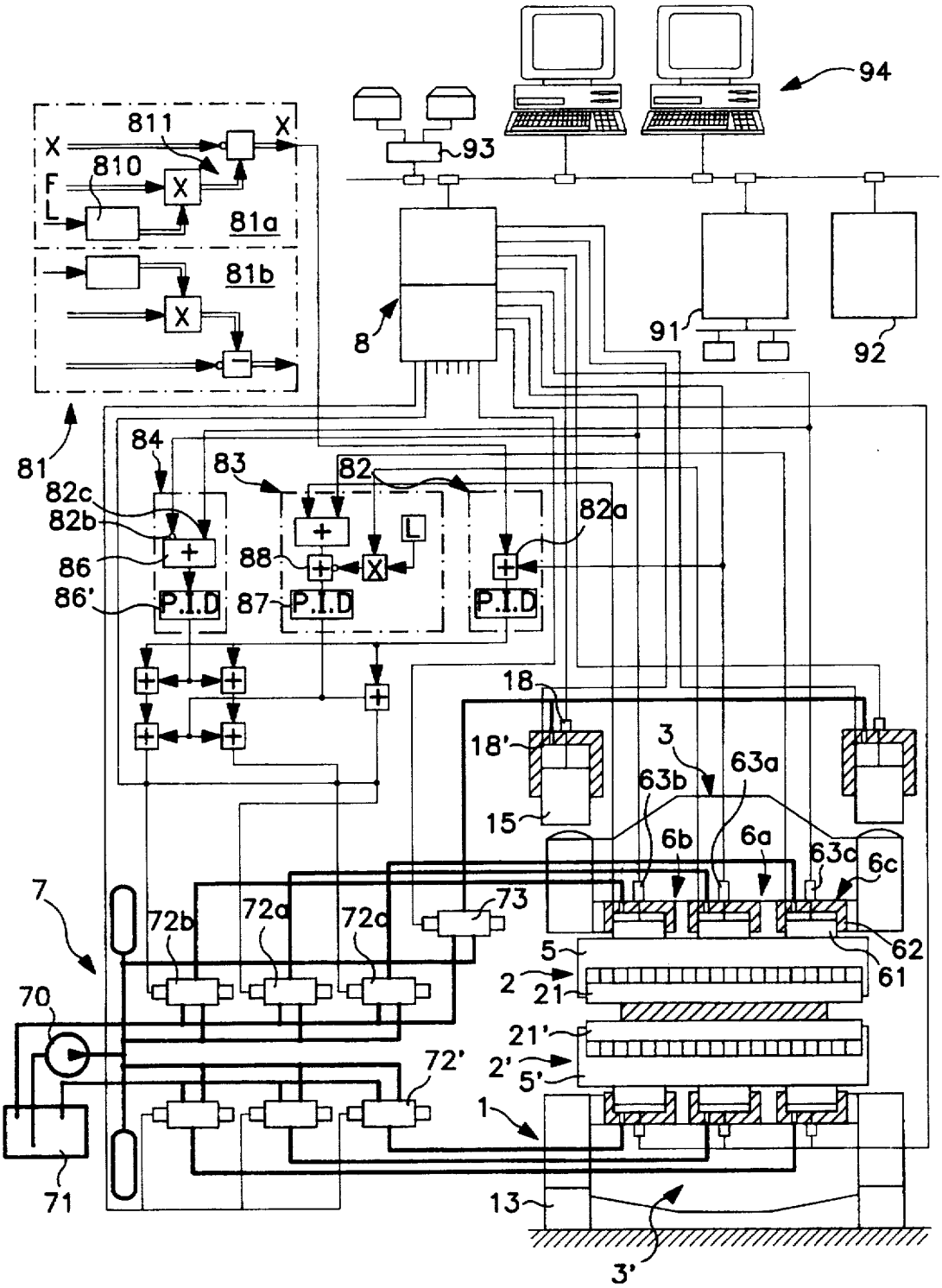
FIG. 4 is an overall diagram of the jack control circuits.

FIG. 4 schematically shows the command and control circuits of a planishing machine allowing such adjustments.

In the case of the nine-roll machine shown in FIGS. 1 and 2, for the purposes of a simple example, the upper planishing system comprises four rolls 21 interposed between the five rolls of the lower system.

Each planishing roll is associated with three oblong jacks 6, the machine therefore comprising a total of twenty-seven jacks supplied by a hydraulic circuit 7 comprising, in a known way, a pump 70, a tank 71 and twenty-seven servo-valves 72 each associated with one of the jacks 6.

Moreover, the four pressure jacks 15 of upper bearing beam 3 are also supplied with oil, each via a servo-valve 73.

To simplify the drawing, FIG. 4 only shows two planishing rolls, respectively upper 21 and lower 21', each associated with a support girder 5, 5' bearing on the corresponding bearing beam 3, 3' via a series of three valves 6, 6', only servo-valves 72, 72' corresponding to these six jacks being shown with the corresponding circuits.

Likewise, only one servo-valve 73 is shown to symbolize the supply of the four jacks 15 that press against upper bearing beam 3.

Of course, the hydraulic circuits, shown only very schematically, contain all the usual organs for normal operation, and particularly pressure relief valves mounted in the circuits corresponding to each row of jacks. As a result, the planishing force taken by each roll, which corresponds to the sum of the pressures applied to the corresponding jacks, can be limited to a safety value thus avoiding any risk of damage to the machine due, for example, to forces being too unequally distributed between the rolls.

According to the invention, the control of the position and of the pressure of each of the twenty-seven jacks 6, 6' is ensured by an automatic regulation system 8 linked, in a conventional way, via a communication network, to various command and control equipment such as a sequential automaton 91 for controlling the successive operations of the planishing machine, an automaton for controlling auxiliary equipment 92, and various interface elements 93, 94, allowing the operator, notably, to determine or modify if necessary the adjustment parameters of the machine and to monitor the operation of both said machine and the regulation system and to intervene when necessary.

Such systems are normally used to control industrial installations and do not therefore need to be described in detail here.

As already seen, each jack 6 that bears on a girder 5 is associated with a position sensor 63 and a pressure sensor 65 which send signals representative of the position of piston 62 and of the pressure in chamber 64 of jack 6. These signals are applied to the corresponding inputs of regulation system 8. This system also receives signals corresponding to, respectively, the position and the pressure of each jack 15 that bears on the beam, and which are supplied by position sensors 18 and pressure sensors 18' associated with each jack 15.

Regulation system 8 processes this information and then sends correction orders which are applied to the control solenoids of servo-valves 72, 72' and 73.

For this purpose, regulation system 8 comprises a certain number of command and regulation units and, in particular, a yield compensation automaton 81 comprising two parts **81*a*, 81*b* assigned, respectively, to upper bearing beam 3 and lower bearing beam 3' a position slaving automaton 82, a profile straightness slaving automaton 83 and an automaton for controlling horizontalness 84, which are associated with each of girders 5, 5'**.

To simplify the drawing, FIG. 4 shows only the regulation loops of the jacks of one girder 5 supporting an upper roll 21, the same circuits, however, being associated with the jacks of all the other rolls.

In a general way, the object of the regulation system is to maintain the central position of each roll at its reference value and to control the horizontalness and straightness of the live generating line in contact with the strip to be planished. The term horizontalness relates to the base level defined by the fixed lower bearing beam 3', and which may not be strictly horizontal due to the yielding and possible deformation of the different supports.

The base level corresponds therefore, off load, to the feed plane P defined by rolls 21' of lower planishing system 2'. The position of bearing beam 3 adjusted by jacks 15 makes it possible to define a reference level for upper system 2 that is strictly parallel to the base level of lower system 2', and in relation to which the imbrication adjustments of the upper rolls are made, the objective being to produce a sheet having a perfectly rectangular section by maintaining the straightness and parallelism of the live generating lines of the rolls of the two systems, respectively upper and lower.

Sensors 63 of each jack 6 allow the position of piston 62 in relation to body 61 of the jack to be known at all times, but because of the elastic deformations of the mechanical elements when acted upon by the various forces, the measured values do not directly represent the position of the live generating lines of corresponding planishing roll 21, and must therefore be corrected by the yield compensation automaton 81 by taking into account the width L of the product in the elasticity matrix 810. The compensation automaton 81 multiplies the measuring vector of the planishing force F, corresponding to the sum of the pressures of the three jacks measured by sensors 64, by the elasticity matrix 810 of the mechanical assembly to obtain the correction to make to the desired position $X_O$, corresponding to the planishing force at the level of the considered roll, which is determined by the mathematical model in regulation system 8. Automaton **81*a* thus forms a signal corresponding to the effective position X of the live generating line of the considered roll which is sent to regulator 82. The latter determines the difference between the effective position X to provide and the position measured by corresponding sensor 63 and sends a correction signal to the position reference of central jack 6*a* to corresponding servo-valve 72*a* in order to obtain the correct position X of roll 21** at its center.

The horizontalness control automaton 84 comprises a comparator 86 whose two inputs **84*b*, 84*c* receive the signals sent by position sensors 63*b*, 63*c* corresponding to the positions of the two jacks 6*b*, 6*c* in relation to the reference level defined by upper bearing beam 3**.

The difference between these two signals, calculated by a P.I.D. regulator 86', is sent as a more or less signal to the command circuits of servo-valves **72*b*, 72*c* associated respectively with the two side jacks 6*b*, 6*c*** in order to permanently reduce this difference to zero.

The signals representing the pressures in the three jacks **6*a*, 6*b*, 6*c* measured by corresponding sensors 65 are presented to the input of the profile straightness slaving automaton 83 which comprises a P.I.D. type regulator 87 associated with comparators 88 designed to distribute the pressures of the three jacks in such a way that if the reactive power of the metal is assumed to be uniform across its width, the live generating line of roll 21** is straight.

The ratio between the force at the center and the side forces is a function of width L of the planished sheet. The difference between the sum of the side forces and the corresponding reference is calculated by P.I.D. regulator 87 which sends a correction signal that acts simultaneously on side servo-valves **72*b*, 72*c* and, in the opposite direction on central servo-valve 72*a***, so as to cancel out this effect.

It can be seen that the regulation system just described, thanks to its multiple adjustment possibilities, makes it possible to simultaneously or separately control the absolute level, the straightness and the parallelism of each live generating line 21 in relation to a reference level defined by the bearing beam, and consequently the degree of imbrication and the distribution of planishing forces between the rolls which define a perfectly rectangular passage gap.

In addition, by acting on the distribution of pressures between the central jack and side jacks, it is possible to modify the distribution of the stresses over the length of each roll, for example, to take into account flaws detected across the width of the strip.

Moreover, controlling the position and pressure of the jacks which bear on each roll makes it possible to determine an optimal undulated profile by effecting the bends required to obtain good planishing operation.

Indeed, it is known that in a multiroll planisher, a certain number of alternate deflections are performed, the object being to suppress the differences in length of fibers, each deflection being brought about by a group of three rolls whose degree of imbrication is defined by taking into account the characteristics of the sheet and the planishing effect required at the level of the considered roll.

Thus, in the case shown in FIG. 2 of a nine-roll planisher, the position of the jacks of all the rolls can be adjusted to define, on successive rolls, bends diminishing from the input towards the output of the planisher, the pressures in the jacks being adjusted so as to limit the force supported by each roll.

However, as already seen, the arrangements according to the invention allow the position and pressure of each roll to be individually adjusted, allowing them to define a given undulation profile determined by the mathematical model according to the characteristics of the sheet.

Moreover, any combination is possible, some rolls having, for example, a fixed position set by adjusting the position of their jacks, whereas other rolls can adapt to the undulations defined by the fixed rolls by exerting a force on the sheet determined simply by adjusting the pressure of the corresponding jacks.

Figure 5:
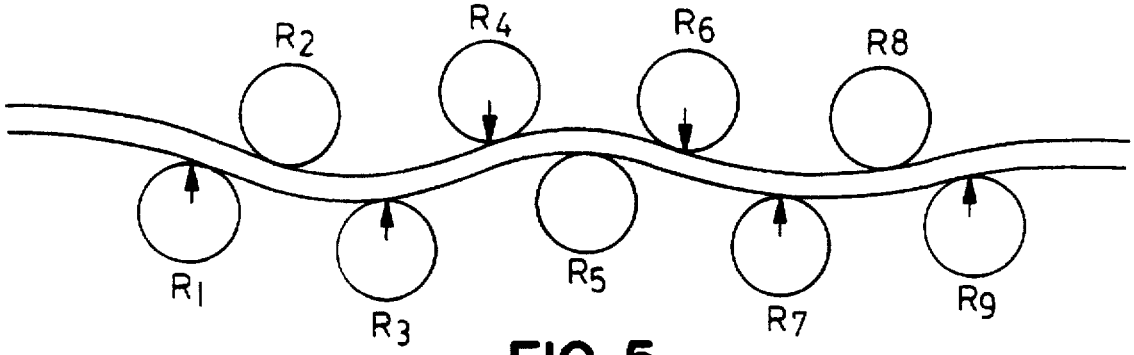
FIG. 5 shows schematically a particular arrangement of the planishing rolls.

For the purposes of an example, FIG. 5 shows a diagram of a nine-roll planisher in which only the jacks corresponding to rolls R1, R2, R5, R8 and R9 are adjusted in position, the jacks of the other rolls R3, R4, R6, R7 simply being adjusted in pressure so as to apply a given force to the sheet but without fixing the position of the corresponding roll.

As a result, each fixed position roll R2, R5, R8 is surrounded by two rolls located on the other side of the strip and adjusted only in pressure so as to exert on either side of the fixed roll, forces on the strip which cause a certain bend depending on the characteristics of the strip and the pressures applied.

Each group of three rolls causes a bend, in one direction or the other, on the corresponding fixed roll and results in an undulation having three alternate bends, the profile of which depends on the stiffness of the strip, the positions of the fixed rolls R2, R5, R8 and the pressures applied by the other rolls.

In this case, the passage from one bend to the next depends on the characteristics of the strip and it should be noted that the bends are not necessarily centered on the fixed rolls.

However it was also possible to adjust the position of all rolls and define the undulated profile shown in FIG. 5, for example.

Indeed, the mathematical model can, according to the different parameters, particularly the nature of the metal and the dimensions of the strip, define an optimal undulation profile which is not necessarily linked to the number of rolls and their spacings, the regulation system determining the positions and pressures to assign to the different rolls according to the row of each of them in order to obtain the profile required.

An essential advantage of the invention resides therefore in the fact that the profile of the undulations can be modified at will simply by adjusting the levels and pressures applied on all rolls.

It is therefore possible to vary the number of alternate bends and their amplitude and, as a result, the effect of planishing, according to the characteristics of the sheet, without modifying the spacing of the rolls which all remain in contact with the sheet and can therefore be driven in rotation and serve to advance the strip, the necessary driving torque being distributed over all the rolls.

The invention is not of course limited to the details of the embodiment just described for the purposes of an example, it being possible to use similar arrangements to ensure the same functions and obtain the same results without leaving the scope of the protection defined by the claims.

In particular, each girder could be associated with only two jacks making it possible to adjust the level and a possible inclination of the corresponding live roll. Conversely, a greater number of jacks could be used, particularly if they are given a circular section.

Nonetheless, the use of jacks with an elongated section, particularly oblong, has the essential advantage of giving the largest live surface and, as a result, the maximum force for a minimum number of jacks distributed over the whole surface of the girder facing the bearing beam.

As a result, it is possible, according to the invention, to obtain a large degree of freedom in the adjustment of the relative levels of the rolls and their imbrications without any undue increase in the complexity of the regulation system.

The invention is also applicable to any type of multiroll planisher, with the planishing systems able to comprise a greater or smaller number of rolls. Furthermore, it is not necessary for each and every roll to be associated with a supporting beam and adjustment jacks, it being possible for some rolls to be fixed.

Other combinations are also possible, with the installation able to adapt to formats and characteristics of sheets, and able to effect all the necessary corrections Moreover, it is possible to perform an automatic vertical adjustment of the input and/or output rolls in order to automatically control the engagement and disengagement phases of the sheet for different products.

We claim:

1. An imbricating roll planisher for planishing a metal strip moving in a longitudinal feed direction, said planisher comprising:

(a) a fixed supporting stand (1), having two vertical members spaced (11, 11') apart on either side of a longitudinal median plane;

(b) a resistant lower bearing beam (3') and a resistant upper bearing beam (3), spaced apart from each other;

(c) parallel lower and upper roll planishing systems, located respectively above and below said metal strip and comprising rolls imbricated in a manner such as to set up an undulated path for said metal strip, said lower planishing system (2') bearing upon said lower bearing beam (3') and said upper planishing system (2) bearing upon said upper bearing beam (3);

(d) each of said planishing systems (2, 2') comprising a row of parallel planishing rolls (21) each associated with at least one row of pressure rolls (22);

(e) a plurality of cross-girders (5) equal in number to said planishing rolls (21), said cross-girders being arranged adjacent to one another and mounted so as to slide in a frame (40), independently of each other, each in a clamping plane (P1) passing through an axis of a corresponding planishing roll (21), a width of each cross-girder (5) being at most equal to a distance between axes of said planishing rolls (21), each planishing roll (21) bearing, over its entire length, on the associated cross girder (5) via its supporting pressure rolls (22);

(f) each cross-girder (5) bearing individually on a bearing beam (3) via a row of at least two hydraulic adjustment jacks (6) interposed between said bearing beam (3) and said cross-girder (5) and distributed across a length of said cross-girder (5);

(g) ends of each planishing roll (21) being mounted for rotation on centering bearings (23) linked respectively to corresponding ends of the associated cross-girder (5), in such a way as to allow limited relative displacement of said centering bearings (23) of the roll (21) in relation to said cross-girder (5) when acted on by said hydraulic jacks (6), each cross-girder (5) distributing an effect of said adjustment jacks (6) across the entire length of the associated planishing roll (21) without interfering with sliding of said cross-girder (5);

(h) means for individually adjusting positions of said at least two jacks (6) interposed between said bearing beam (3) and each cross-girder (5) for individual adjustment of a profile and level of said cross-girder (5) and the associated planishing roll (4) in relation to the mean feed plane of said metal strip;

(i) means for individually adjusting pressure of said at least two jacks (6) interposed between said bearing beam (3) and each cross-girder (5) for individual adjustment of a clamping force supported by the associated planishing roll (4);

(j) each adjustment jack (6) having an elongated section and comprising a piston (62) whose width in a direction transverse to said girder (5) does not substantially exceed a width of said girder (5) and whose length is so determined as to define a useful section of said piston (62) compatible with a bearing force to be exerted taking into account the number of jacks associated with said girder (5).

2. The roll planisher of claim 1, wherein the jacks (6) have an oblong section with rounded ends.

3. The roll planisher of claim 1, wherein each cross girder (5) bears upon the bearing beam (3) via at least three jacks (6) of elongated section., respectively a central jack and two side jacks distributed across the length of the girder.

4. The roll planisher of claim 1, wherein the pressure jacks (6) are mounted in at least one intermediate supporting piece (33) interposed between the bearing beam (3) and the cross girders (5).

5. The roll planisher of claim 4, wherein the piece (33) supporting the jacks (6) extends across the whole surface of the planishing system (2) and is provided with several rows of cavities (34) corresponding each to a cross girder (5), and each defining a body (61) of a jack (6) in which a piston (62) is mounted in a sliding way which bears upon the cross girder (5).

6. The roll planisher of claim 5, wherein the bodies (61) of the jacks (6) located at the same level on the different cross girders (5) are brought together in a single piece (61') extending over all the girders (5) and in which a series of cavities (34) is provided centered respectively on said girders (5) and each forming the body (61) of a jack (6) whose piston (62) bears upon the corresponding girder (5).

7. The planisher of claim 1, wherein the supporting chassis (4) comprises a rectangular the frame (40) is associated surrounding all the rolls (21, 22) and associated with a plurality of transverse guide bulkheads (41) parallel to the axis of the rolls (21) and spaced apart from each other so as to define elongated cavities (45) equal in number to the rolls and in which the cross girders (5) are housed, the two ends of each cross girder being provided with means (52, 52') for bearing against the frame with the possibility of sliding.

8. The roll planisher of claim 7, wherein each cross girder (5) has a rectangular cross section whose height is at least equal to its width, in order to present sufficient inertia so that said girder (5) constitutes, with the live roll (21) and the corresponding support rolls, a semirigid assembly able to deform according to the distribution of forces applied to the length of the associated live roll (21), with the possibility of sliding inside the corresponding cavity (45).

9. The roll planisher of claim 1, wherein the supporting chassis (4) is closed, on the side furthest from the rolls, by a plate (43) covering all the cross girders (5) and linking the sides of the frame (40) so as to form a box, said plate (43) being provided with, at right angles to each girder (5), a plurality of passage holes (44) for the pistons (62) of the jacks (6) interposed between each girder (5) and the bearing beam (3).

10. The roll planisher of claim 1, wherein the assembly formed by the hollow piece forming a frame (40) and the cross girders (5) with the live rolls (21) and the associated supporting rolls (22), form a cartridge which can be withdrawn from the planisher by displacement parallel to the axes of the rolls (21).

11. The roll planisher of claim 10, wherein in the working position, each cartridge is pressed against the corresponding bearing beam (3) by movable clamping devices (36) which bear on said bearing beam (3).

12. A process for adjusting the planishing effect performed on a strip moving in a longitudinal feed direction x'x in an imbricated roll planisher comprising resistant lower and upper bearing beams, comprising the steps of adjusting a position of one of said bearing beams in relation to the other of said bearing beams to determine a reference level of one of two entire planishing systems in relation to the other of said planishing systems, mounting each planishing roll, with associated pressure rolls, on a cross girder mounted for sliding movement perpendicular to a passage plane of said strip and bearing on the corresponding bearing beam via at least two hydraulic jacks, precisely determining relative levels of at least one group of planishing rolls relative to said reference level, by individual adjustment of rolls of said group, so as to define a given degree of imbrication of each of said rolls, pressures applied on each of said jacks being limited to a safety value corresponding to a maximum planishing force taken by each planishing roll.

13. The process of claim 12, wherein each girder is associated with at least three pressure jacks, respectively a central jack and two side jacks, the process further including controlling the level of each planishing roll corresponding to a given degree of imbrication by adjusting the position of the central jack of the corresponding beam, according to foreseeable yielding of different parts of the stand, taking into account the forces applied, determining the difference between the measured positions of the two side pressure jacks of said girder, and then collecting said positions to bring the measured difference back to a reference difference corresponding to the parallelism of the roll with the reference level.

14. The process of claim 13, including the step of distributing the pressures between the three jacks taking into account their relative positions, so that the live generating line of the considered planishing roll in contact with the product is maintained in a straight line.

15. The process of claim 12, wherein the planisher comprises an odd number n of imbricated rolls, respectively 1, 3, 5 . . . n on one of the systems and 2, 4, 6 . . . n−1 on the other system, the position of the jacks corresponding to at least two rolls, respectively (p) and (q) of each of the two systems, located respectively above and below the strip, is adjusted, and the pressure of the two jacks corresponding to the two pairs of rolls, respectively p−1, p+1 and q−1, q+1 surrounding each of said rollers (p, q) adjusted in position is adjusted so as to determine at least two bends in opposite directions on said rollers (p, q), the positions of the latter in each of the two systems and their relative levels in relation to the reference level, in addition to the pressures applied on the rolls surrounding them, being determined according to the characteristics of the strip to be planished so as to obtain the planishing effect required.

* * * * *